US008125500B2

(12) United States Patent
Thebault et al.

(10) Patent No.: US 8,125,500 B2
(45) Date of Patent: Feb. 28, 2012

(54) APPARATUS FOR DRIVING A PLASMA DISPLAY PANEL WITH APL PRE-MEASUREMENT AND CORRESPONDING METHOD

(75) Inventors: Cédric Thebault, Villingen-Schwenningen (DE); Carlos Correa, Villingen-Schwenningen (DE); Sébastien Weitbruch, Kappel (DE)

(73) Assignee: Thomson Licensing, Boulogne-Billancourt (FR)

( * ) Notice: Subject to any disclaimer, the term of this patent is extended or adjusted under 35 U.S.C. 154(b) by 1223 days.

(21) Appl. No.: 11/607,615

(22) Filed: Dec. 1, 2006

(65) Prior Publication Data

US 2007/0132668 A1 Jun. 14, 2007

(30) Foreign Application Priority Data

Dec. 12, 2005 (EP) ..... 05292660

(51) Int. Cl.
*G09G 5/10* (2006.01)

(52) U.S. Cl. ..... 345/690; 348/687; 348/673; 348/678; 348/797; 348/795; 345/63; 345/60; 345/211

(58) Field of Classification Search ..... 348/E3.014, 348/673, 68, 372, E5.127, 797; 345/63, 690
See application file for complete search history.

(56) References Cited

U.S. PATENT DOCUMENTS 5,757,343 A 5/1998 Nagakubo et al.

(Continued)

FOREIGN PATENT DOCUMENTS

| | | |
|---|---|---|
| EP | 1014330 A | 6/2000 |
| EP | 1347434 A | 9/2003 |
| EP | 1453032 | 9/2004 |

OTHER PUBLICATIONS

Patent Abstracts of Japan, vol. 2003 , No. 4, Apr. 2, 2003, -&JP 2002 351392 A (Matsushita Electric Ind Co. LTD), Dec. 6, 2002, abstract, the whole document.
Search Report dated May 19, 2006.

*Primary Examiner* — Brian Yenke
*Assistant Examiner* — Omer Khalid
(74) *Attorney, Agent, or Firm* — International IP Law Group, PLLC

(57) ABSTRACT

A picture quality when reducing the brightness or the contrast of the picture on a plasma panel shall be improved. For this purpose there is provided a driving apparatus including brightness/contrast control means for receiving video input data for modifying the video levels of the video input data in accordance with external adjustment data and for outputting modified video data. First power measurement means measure a power level of the modified video data and supply a first power level. Second power measurement means measure a power level of the video input data and supply a second power level. Generator means generate a third power level comprised between the first power level and the second power level or equal to the larger one to data processing means. The data processing means calculate the maximum number of sustain pulses per frame applicable to the modified video data on the basis of the third power level and control the display of the modified video data on the plasma display panel. Thus, the number of gray levels can be increased and the picture quality improves significantly.

14 Claims, 4 Drawing Sheets

U.S. PATENT DOCUMENTS 6,597,333 B2 * 7/2003 Todoroki et al. ..... 345/63
6,967,646 B2 * 11/2005 Hosoi et al. ..... 345/204
2002/0140640 A1 10/2002 Watanabe
2003/0164810 A1 * 9/2003 Kim ..... 345/63
2005/0212933 A1 * 9/2005 Miyanohara ..... 348/272

* cited by examiner

APPARATUS FOR DRIVING A PLASMA DISPLAY PANEL WITH APL PRE-MEASUREMENT AND CORRESPONDING METHOD

FIELD OF THE INVENTION

This application claims the benefit, under 35 U.S.C. §119 of European Patent Application 05292660.7, filed Dec. 12, 2005.

The present invention relates to an apparatus for driving a plasma display panel including brightness/contrast control means for receiving video input data, for modifying the video levels of the video input data in accordance with external adjustments data and for outputting modified video data and power measurement means for measuring a power level of the modified video data. Furthermore, the present invention relates to a corresponding method.

BACKGROUND OF THE INVENTION

A PDP (plasma display panel) uses a matrix array of discharge cells, which can only be "ON", or "OFF". Also unlike a CRT (cathode ray tube) or LCD (liquid crystal display) in which gray levels are expressed by analog control of the light emission, a PDP controls the gray level by modulating the number of light pulses per frame (sustain pulses). This time-modulation will be integrated by the eye over a period corresponding to the eye time response. Since the video amplitude is portrayed by the number of light pulses, occurring at a given frequency, more amplitude means more light pulses and thus more "ON" time. For this reason, this kind of modulation is also known as PWM, pulse width modulation.

For all displays using pulse width modulation, the number of real gray levels is limited. For PDP, in case of standard coding the number of gray levels is more or less equal to 256.

These various gray levels can only be used when the dynamic of the input picture is at its maximum (in case of 8 bit signal, video values between 0 and 255). In other cases, when the dynamic is reduced (in particular because of contrast or brightness parameters), the number of displayed levels will further decrease.

The problem is that the picture quality is affected when the number of displayed levels is reduced.

Unfortunately, when reducing the contrast (by dividing by a certain factor) and/or the brightness (subtracting a certain coefficient from the picture), the maximum value of the picture decreases and so the picture quality is reduced.

Figure 3:
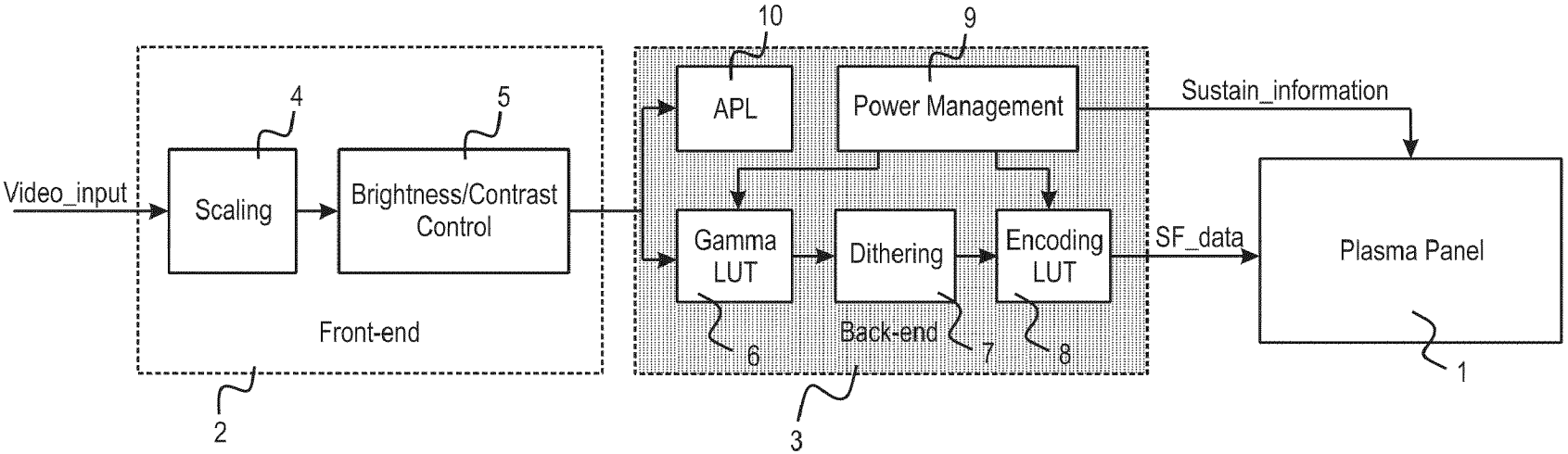
FIG. 3 Prior Art

Contrast and brightness controls are usually part of the so called "front-end", while PDP specific functions (gamma function, Sub-field encoding, etc) are part of the so called "back-end" of the display (see FIG. 3).

In the back-end of a PDP an APL function is used to control the power. The computation of this Average Power Level (APL) is made through the following function:

$$APL(I(x, y)) = \frac{1}{C \times L} \cdot \sum_{x,y} I(x, y)$$

where I(x,y) represents the picture to display, C the number of columns and L the number of lines of the PDP.

The aim of power management is to keep the power consumption constant (see FIG. 1) and to have a peak luminance as high as possible. So for every APL value, the maximal number of sustain pulses to be used is fixed.

Figure 2:
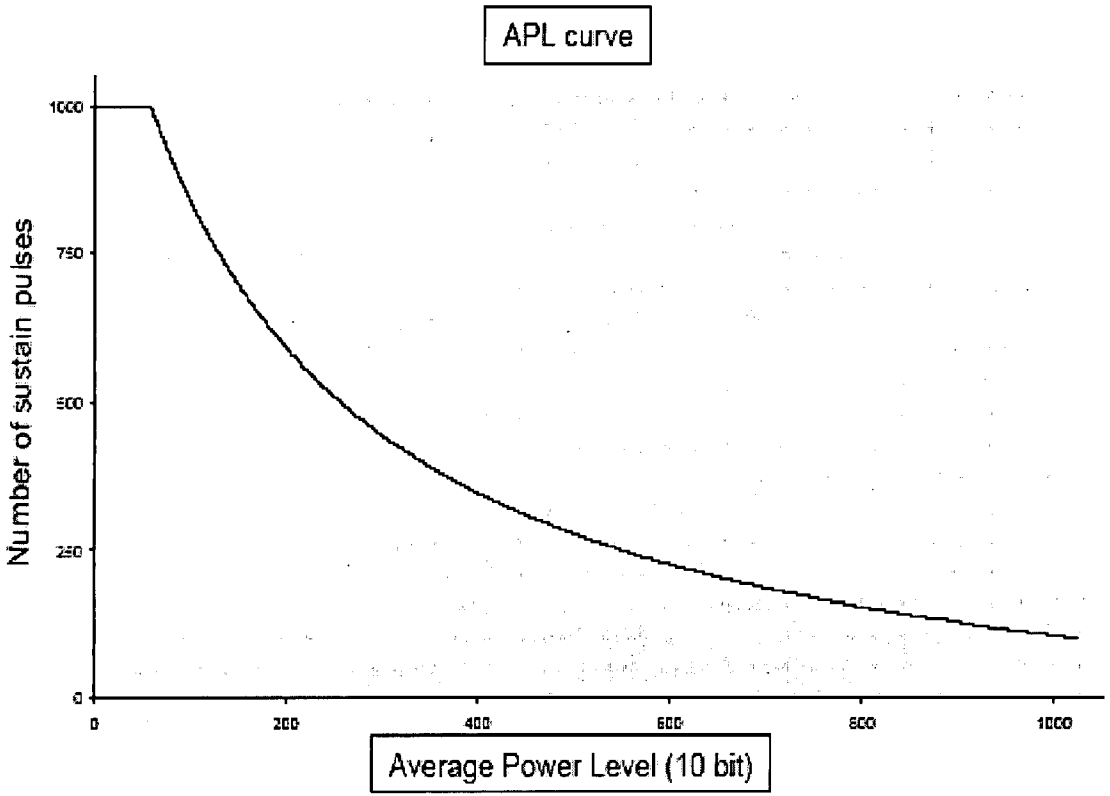
Fig. 2 Prior Art

This number of sustains decreases when the APL increases, and vice versa shown in FIG. 2.

In peak-white pictures (low APL at the left side of FIG. 2), the number of sustain pulses is not limited by the power consumption, but by the available time for sustaining. For this reason, the power consumption of peak-white picture will be lower than for the other pictures. Consequently, also the power consumption decreases for low APL levels (compare FIG. 1).

The following table shows an allocation of the values of the number of sustain pulses to the average power levels according to FIG. 2. The average power levels are coded on 10 bits.

| APL | Total Number of sustains |
|---|---|
| 0 | 1000 |
| 1 | 1000 |
| 2 | 1000 |
| 3 | 1000 |
| 4 | 1000 |
| 5 | 1000 |
| . | |
| . | |
| . | |
| 50 | 1000 |
| 51 | 1000 |
| 52 | 1000 |
| 53 | 1000 |
| 54 | 1000 |
| 55 | 1000 |
| 56 | 999 |
| 57 | 998 |
| 58 | 996 |
| 59 | 994 |
| 60 | 991 |
| 61 | 988 |
| 62 | 984 |
| 63 | 979 |
| 64 | 975 |
| 65 | 971 |
| 66 | 966 |
| 67 | 962 |
| 68 | 958 |
| 69 | 954 |
| 70 | 950 |
| 71 | 946 |
| 72 | 942 |
| 73 | 938 |
| 74 | 933 |
| 75 | 929 |
| . | |
| . | |
| . | |
| 295 | 449 |
| 296 | 448 |
| 297 | 447 |
| 298 | 446 |
| 299 | 445 |
| 300 | 444 |
| 301 | 442 |
| 302 | 441 |
| 303 | 440 |
| 304 | 439 |
| 305 | 438 |
| . | |
| . | |
| . | |
| 1005 | 102 |
| 1006 | 102 |
| 1007 | 102 |
| 1008 | 102 |
| 1009 | 102 |
| 1010 | 102 |
| 1011 | 101 |
| 1012 | 101 |
| 1013 | 101 |

-continued

| APL | Total Number of sustains |
|---|---|
| 1014 | 101 |
| 1015 | 101 |
| 1016 | 101 |
| 1017 | 100 |
| 1018 | 100 |
| 1019 | 100 |
| 1020 | 100 |
| 1021 | 100 |
| 1022 | 100 |
| 1023 | 100 |

As indicated above, the problem of the standard implementation of power management is that when the energy of the input picture of the back-end decreases, the number of sustain pulses increases.

FIG. 3 shows a principle block diagram of the driving unit of a plasma panel 1. The video input signal is first processed in the front end 2. The front end includes a scaling unit 4 for adapting the size of the picture to that of the panel. The scaled input signal is supplied to a brightness/contrast control block 5. This control block 5 receives external signals for tuning or modifying the brightness or the contrast of the picture. The video signal is processed respectively and supplied to the back end 3. Within the back end 3 the signal is processed in a usual path including a gamma block 6, a dithering block 7 and an encoding block 8. The gamma block 6 performs a data transformation with a look up table in accordance to a nearly quadratic gamma function. The output signal of the gamma block 6 is transmitted to the dithering unit 7 which will add for example 4 bit dithering in order to have more discrete video levels at the output. Afterwards, the sub field encoding 8 generates sub field data for the video signal. The resulting sub field data are sent to the plasma panel 1.

In a parallel path within the back end 3 the output signal of the front end 2 is input into an APL measurement block 10. This block supplies an APL level of the brightness/contrast tuned video signal to the power management 9. The power management 9 controls the gamma unit 6 and the encoding unit 8. Furthermore, the power management 9 delivers sustain information to the plasma panel 1.

With this arrangement, it is for example interesting to see what happens when the user is decreasing the contrast and/or the brightness.

When decreasing the contrast and/or the brightness, the APL (measured in the back-end 3) is decreasing; this means that the number of sustains is increasing. This increases partly the contrast.

For example, the user wants to reduce the contrast by 2 for a picture, which has an APL of 300 (10 bit value). So originally this picture has in average approximately 444*300/1024=130 sustains/cell, and can have a peak luminance of 444 sustains (compare table shown above).

To obtain in average 130/2=65 sustains/cell, the user in fact has to reduce the contrast of the picture by around 4. For an APL value of 70, according to the table, the average number of sustain is equal to 950*70/1024=65. The peak luminance in this case is also reduced since all brightness levels of the whole picture are divided by more than 4, the maximum value of the picture will not be higher than 255/4.3=60 (this represents 950/4.3=222 sustains). But since, the picture is divided by more than 4, the number of gray levels really used is also divided by around 4. The picture quality is rather low in this case.

SUMMARY OF THE INVENTION

In view of that, it is the object of the present invention to provide a driving apparatus for a plasma display panel which improves the picture quality, when the brightness and contrast of the picture are reduced. Furthermore, a respective method shall be provided.

According to the present invention this object is solved by an apparatus for driving a plasma display panel including brightness/contrast control means for receiving video input data, for modifying the video levels of the video input data in accordance with external adjustment data and for outputting modified video data, first power measurement means for measuring a power level of said modified video data and for supplying a first power level, second power measurement means for measuring a power level of said video input data and for supplying a second power level, generator means for generating a third power level comprised between said first power level and said second power level or equal to the larger one of said first and second power levels, and data processing means (9) for calculating the maximum number of sustain pulses per frame applicable to said modified video data on the basis of said third power level and for controlling the display of said modified video data on said plasma display panel (1) respectively.

Furthermore, there is provided a method for driving a plasma display panel by providing video input data, modifying the video levels of the video input data in accordance with external adjustment data in order to obtain modified video data, measuring a power level of said modified video data and providing a respective first power level, measuring a power level of said video input data and providing a respective second power level, generating a third power level comprised between said first power level and said second power level or equal to the larger one of said first and second power levels, and processing said modified video data for calculating the maximal number of sustain pulses per frame applicable to said modified video data on the basis of said third power level and controlling the display of said modified video data on said plasma display panel respectively.

The advantage of the present invention is that the APL level of the input video signal can be considered in the back end before the video signal is modified by the brightness/contrast control unit. Thus, the adjustment of brightness and contrast affects the picture quality on the plasma panel less negative.

According to a preferred embodiment of the present invention the third power level is the larger one of the first power level and the second power level. With this feature it is possible that the total power of the picture remains unchanged even if the brightness or contrast of the picture is varied.

Preferably, the power levels measured in the driving apparatus are average power levels related to one picture.

Furthermore, the data processing means may include power management means for keeping the power consumption of the plasma display panel constant irrespective of the power control information.

DRAWINGS

Figure 1:
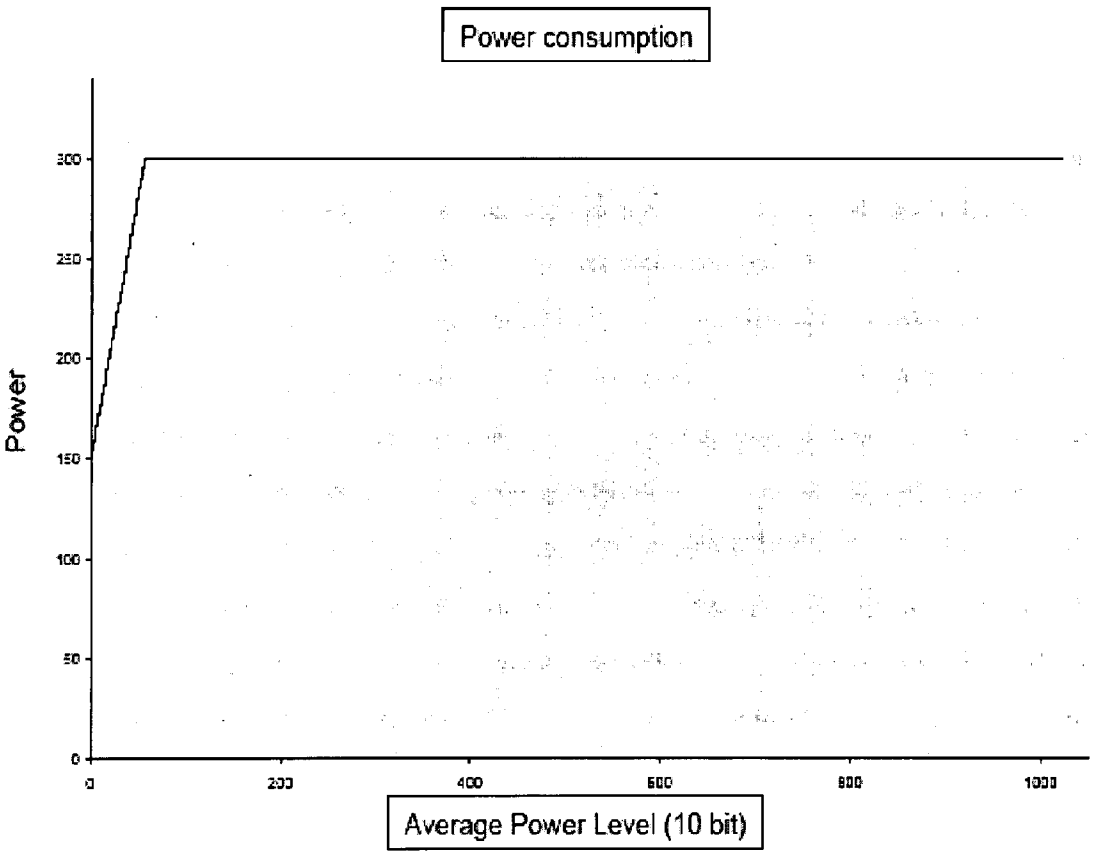
Fig. 1 Prior Art
Figure 4:
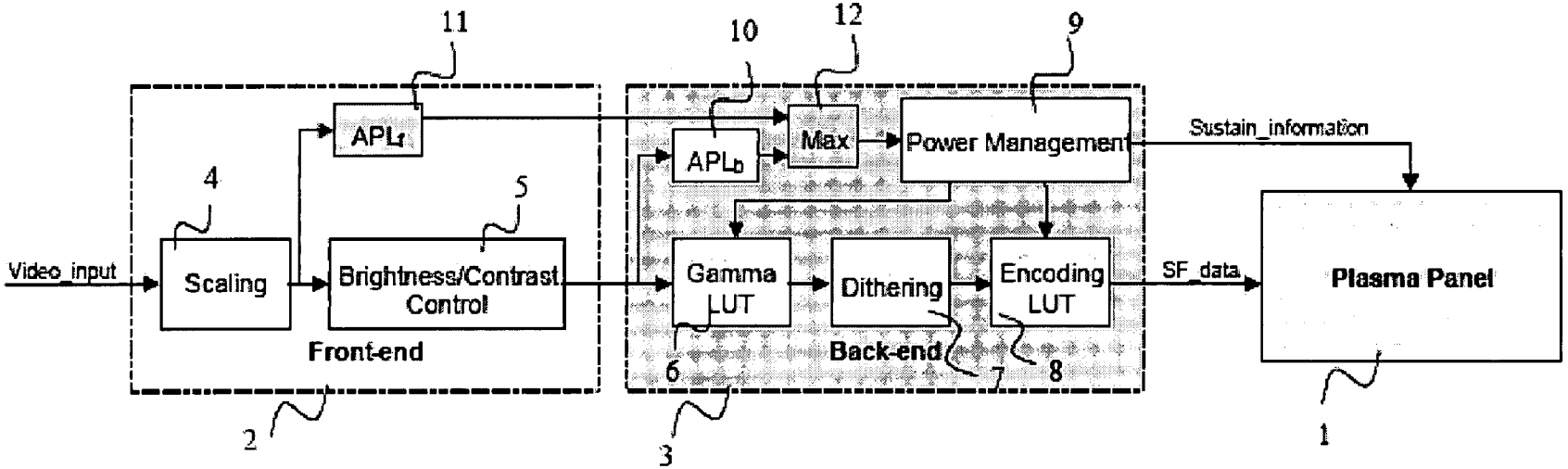

The present invention will now be explained in more detail along with the attached figures, showing in:

FIG. 1 a diagram of the power consumption over the average power level;

FIG. 2 a diagram of the number of sustain pulses over the average power level;

FIG. 3 a block diagram of a driving unit of a plasma panel according to the prior art;

FIG. 4 a block diagram of a driving unit of a plasma panel according to the present invention.

DETAILED DESCRIPTION OF PREFERRED EMBODIMENTS

The purpose of the invention presented here is to improve the behavior of power management regarding contrast and brightness control.

The idea is that when contrast and/or brightness decrease, the power management should not increase the number of sustains. Otherwise the user needs to further decrease the contrast and/or the brightness. Then, the picture quality would further decrease, too.

This can be done by using for power management 9 the same APL value than the one before the contrast/brightness decrease. This value can be measured with the help of an additional APL measurement unit 11 placed in the front-end 2 before the contrast/brightness control unit 5 as shown in FIG. 4.

However, this value cannot be used directly. Otherwise when the energy is increased by the front-end 2 (by increasing the contrast and/or the brightness for example) the power on the display 1 could be higher than the maximum value allowed. Therefore in this case the power has to be reduced by the power management block 9.

A comparison between FIGS. 3 and 4 shows that except for the units 11 and 12 the other elements 1 to 10 of FIG. 4 are also present in the apparatus of FIG. 3. Therefore, as to the description of these units it is referred to FIG. 3.

As already mentioned, there are two APL measurements: one in the front-end 2, and the other one in the back-end 3. The power management unit 9 will use the maximum of these two values to determine the number of sustains to be displayed. This maximum is provided by a comparator unit 12. So the implementation is very simple.

The content of the front-end 2 and the back-end 3 are only given as examples. It is only mandatory in the front-end 2 to have the $APL_f$ measurement unit 11 before the brightness/contrast control 5.

Since this solution can only lead the power management unit 9 to use a higher value of APL, the number of sustains to be displayed can only be reduced. This means that the power consumption will be reduced in this case. This is a real advantage as to the tuning of contrast or brightness.

In a variant implementation, the comparator unit 12 can be replaced by a generator unit 12 that generates an APL level that is comprised between the two measured APL levels. This APL value should be greater than $APL_b$ and, if $APL_f > APL_b$, said APL value can be any value comprised between $APL_b$ and $APL_f$.

Now, the example of the introductory part of the description shall be regarded again. The APL measured in the front-end is equal to 300. The user wants to reduce the contrast by 2. Since the APL in the back-end 3 will decrease, the power management unit 9 will use the APL measured in the front-end 11, this means 300, and so the same number of sustains is used. Therefore in order to reduce the contrast by 2, the video has to be divided by 2. The APL measured in the back-end 3 is equal to 150 in this case.

The power management 9 uses the value 300 as input. The average number of sustains is equal to 444*150/1024=65, but the maximum value of the picture will be 255/2=127. So the number of gray levels really used will be divided by around 2. This means that the number of gray levels really used is twice as big as in the standard implementation. So finally the picture quality is significantly improved.

In summary, the invention presented in this document aims at improving the picture quality when the contrast and/or the brightness are reduced. This is achieved by implementing an APL (Average Power Level) function in the front-end and using the measured value in the back-end.

The invention claimed is:

1. Apparatus for driving a plasma display panel, including:

brightness/contrast control means for receiving video input data, for modifying the video levels of the video input data in accordance with external adjustment data and for outputting modified video data;

first power measurement means for measuring a power level of said modified video data and for supplying a first video data power level;

second power measurement means for measuring a power level of said video input data and for supplying a second video data power level;

generator means for generating a third video data power level between said first video data power level and said second video data power level as long as the second video data power level is higher than the first video data power level, or for generating the third video data power level equal to the larger one of said first and second video data power levels; and data processing means for calculating the maximum number of sustain pulses per frame applicable to said modified video data on the basis of said third video data power level and for controlling the display of said modified video data on said plasma display panel respectively.

2. Apparatus according to claim 1, wherein said video data power levels are average power levels related to one picture.

3. Method for driving a plasma display panel, comprising:

providing video input data;

modifying the video levels of the video input data in accordance with external adjustment data in order to obtain modified video data;

measuring a power level of said modified video data and providing a first video data power level;

measuring a power level of said video input data and providing a second video data power level;

generating a third video data power level between said first video data power level and said second video data power level as long as the second video data power level is higher than the first video data power level, or generating the third video data power level equal to the larger one of said first and second video data power levels; and processing said modified video data for calculating the maximum number of sustain pulses per frame applicable to said modified video data on the basis of said third video data power level and controlling the display of said modified video data on said plasma display panel respectively.

4. Method according to claim 3, wherein said video data power levels are average power levels related to one picture.

5. A Plasma Display Panel, comprising:

a front end configured for receiving an input video signal, said front end including:

a front end APL-determining device that determines an average power level of the input video signal;

a control configured for adjusting at least one of the brightness and contrast of the input video signal dependent at least in part upon an external input thereby modifying the input video signal to a modified video signal; and a back end, including:

a back end APL-determining device that determines an average power level of the modified video signal; and a power management unit determining a number of sustain pulses per frame applied to display said modified video signal on said display panel, the number of sustain pulses being dependent at least in part upon the average power levels of said input video signal and said modified video signal.

6. The plasma display panel of claim 5, further comprising a comparator device comparing the average power levels of said input video signal and said modified video signal, said power management unit determining the number of sustain pulses per frame applicable to said modified video signal dependent at least in part upon the comparison of the average power levels of said input video signal and said modified video signal.

7. The plasma display panel of claim 6, wherein the number of sustain pulses per frame applicable to said modified video signal is dependent upon the greater of the average power levels of said input video signal and said modified video signal.

8. The plasma display panel of claim 5, further comprising a generating unit issuing a generated average power level, said generated average power level being dependent at least in part upon the average power levels of said input video signal and said modified video signal, and wherein said power management unit determines the number of sustain pulses per frame applicable to said modified video signal dependent at least in part upon said generated average power level.

9. The plasma display panel of claim 8, wherein said generated average power level is between the average power levels of said input video signal and said modified video signal when the average power level of said input video signal is greater than the average power level of said modified video signal.

10. The plasma display panel of claim 9, wherein said generated average power level is equal to the greater of the average power levels of said input video signal and said modified video signal when the average power level of said input video signal is less than or equal to the average power level of said modified video signal.

11. The plasma display panel of claim 5, wherein said front end further comprises a scaling unit.

12. The plasma display panel of claim 5, wherein said back end further includes a gamma unit.

13. The plasma display panel of claim 12, wherein said back end further includes a dithering unit.

14. The plasma display panel of claim 13, wherein said back end further includes an encoding unit.

* * * * *